United States Patent [19]

Wolfelsperger

[11] 3,948,014

[45] Apr. 6, 1976

[54] INTERNALLY CONTAINED TEAR-INDUCING TAB FOR VACUUM SEALED PACKAGES

[75] Inventor: Robert O. Wolfelsperger, Fairfield, N.J.

[73] Assignee: William E. Young, Atlantic Highlands, N.J.

[22] Filed: Mar. 6, 1975

[21] Appl. No.: 555,868

Related U.S. Application Data

[62] Division of Ser. No. 462,305, April 19, 1974, Pat. No. 3,900,105.

[52] U.S. Cl. ..... 53/14; 53/133

[51] Int. Cl.[2] ..... B65B 9/02; B65B 61/18

[58] Field of Search ..... 53/14, 22 A, 133; 206/239, 206/264, 498; 229/51 CE; 426/123, 129

[56] References Cited

UNITED STATES PATENTS

| | | | |
|---|---|---|---|
| 2,140,021 | 12/1938 | Mallen | 206/264 X |
| 2,178,157 | 10/1939 | Anderson | 206/264 X |
| 3,187,983 | 6/1965 | Mendoza | 229/51 CE |
| 3,491,504 | 1/1970 | Young | 53/22 A |
| 3,636,678 | 1/1972 | Maros | 53/14 |
| 3,661,249 | 5/1972 | Clemens | 229/51 CE |

*Primary Examiner*—Travis S. McGehee
*Assistant Examiner*—John Sipos
*Attorney, Agent, or Firm*—Ralph R. Roberts

[57] ABSTRACT

The present invention pertains to the method for forming vacuum packaged products wherein a tear-inducing tab is provided for easily rupturing the film. This invention is particularly directed toward the wrapping of vacuum packages for packing meat and the like and in which the films used therewith are tough and not amenable to tearing. In this invention is provided a method for forming a flat, substantially inflexible tear tab member having a sharp point. This tear tab is laid on the product to be packaged with the sharp point portion thereof extending therefrom so that after the package has been formed the bending of the seal line of the package at or very near the extending portion of the tear tab causes the point of the tab to puncture the film to permit easy further tearing and eventual uncovering of the product.

6 Claims, 10 Drawing Figures

INTERNALLY CONTAINED TEAR-INDUCING TAB FOR VACUUM SEALED PACKAGES

CROSS-REFERENCE TO RELATED PATENT

This application is a divisional application of my U.S. patent application, Ser. No. 462,305 filed Apr. 19th, 1974 now U.S. Pat. No. 3,900,105 and entitled, "Internally Contained Tear-Inducing Tab for Vacuum Sealed Packages." Division was required by the Examiner's Action dated Dec. 9th, 1974.

BACKGROUND OF THE INVENTION

1. Field of the Invention

With reference to the classification of art as established in the U.S. Patent Office this invention pertains to a method as found in the general Class entitled, "Package Making" (Class 53) and in the subclass entitled, "cover adjunct application or formation" (subclass 47) and in the subclass entitled, "package opening device" (subclass 133).

2. Description of the Prior Art

The packaging of meat and other similar products where the product packaged is in the presence of a small vacuum is well known. In this packaging method the film or films are tightly drawn to the product and remain in a tightly sealed condition until the film is ruptured. Patents disclosing this method are well known. Such a package is found in U.S. Pat. No. 3,491,504 as issued on Jan. 27th, 1970 to W. E. Yound et al. In this and in other apparatus of a like nature the package is formed utilizing a bottom film which usually has thermoplastic characteristics. On this lower film is laid the product to be packaged and on top of the product in a vacuum chamber subsequently opened to atmosphere pressure the upper film is caused to be drawn tightly around the product and at this same time is sealed to the bottom film. Many packages are formed with a film having a good resistance to tear and accidental rupture since the products usually packaged may be subject to rather rough handling particularly under the influence of a substantially frozen or near frozen condition. Opening packages where there is a high resistance to tear usually requires an initial piercing by a sharp instrument. This is, of course, often an inconvenience.

Several patents have dealt with this problem and in particular is noted U.S. Pat. No. 3,184,051 to WINTON as issued on May 18th, 1965 wherein is shown a product wrapped with a tear tab and a strippable sheath. The tab provided with the wrapping of this product and as taught in the patent extends beyond the package films. Such a package, of course, is unacceptable for food and other items required to be protected by the seal of the film. In U.S. Pat. No. 1,722,086 to HAMMERLE as issued on July 23rd, 1929 there is shown a cigarette package wherein a serrated member is adapted to provide a cutting edge for the internal paper enclosing the cigarettes. In U.S. Pat. No. 3,187,983 to MENDOZA as issued on June 8th, 1965 there is disclosed a cellophane wrapper tearing member which is adhered to a carton. The sharp points of the tearing member are adapted to pierce the cellophane when the cellophane is pushed thereagainst. Once ruptured the cellophane is removed with little difficulty. A recent and important patent as to the use of a tear tab is seen in U.S. Pat. NO. 3,641,732 to FUJIO as issued on Feb. 15th, 1972. However, this package utilizes a heat shrink film and the tear tab portion consists of weakening the film itself prior to shipment which, of course, is not the desire of the present invention.

The present invention provides a method of encasing a tab having a projecting point which remains in a concealed condition until a corner of the package is deliberately bent into a folded U-shape and then pressing the film portion against the sharp point to cause a rupture of the film after which the film is torn with a pulling action to expose the product.

SUMMARY OF THE INVENTION

This invention may be summarized at least in part with reference to its objects.

It is an object of this invention to provide, and it does provide, a method for producing a package with a tear-inducing tab. The vacuum package includes an upper and a lower film with the lower of the films generally establishing a heat sealed plane around a product preferably sealed in the presence of a vacuum. Between the films and on this heat sealing line is a flat, sharp-pointed tear-inducing tab whose large portion lays against the product and at the sealing line of the upper and lower films. The pointed end of the tab is maintained in a reasonably protected condition until the package is to be opened by the user and in which the user must use a deliberate tear action to rupture the film.

As to be more fully described hereinafter in conjunction with the drawings, the package of this invention includes upper and lower films which are preferably thermoplastic. The lower film is supported and carried by a platen and prior to the placing of the product on this lower film there is placed a short substantially rigid, flat, tear-inducing member having a very sharp point. The tear-inducing member is arranged so that when the product is placed thereon the sharp point protrudes beyond the edge of the product a short distance. The upper film is not brought into proximity with the product and peripheral sealing relationship with the lower film. The sealing is preferably achieved in a vacuum chamber and subsequent to bringing the product between the films to a condition of reduced pressure, this sealing method following a procedure such as seen in U.S. Pat. No. 3,491,504, above-identified. The packaged product may be one of a series of like or similar products packaged in a line production system and after the package has been formed is separated for shipment to the user usually with the product cooled or frozen.

In addition to the above summary the following disclosure is detailed to insure adequacy and aid in understanding of the invention and to cover the new inventive concept disclosed no matter how it may later be disguised by variations in form or additions of further improvements. For this reason there has been chosen a specific embodiment of the internally contained tear-inducing tab as adopted for use with a sealed package and showing a means for performing the steps of making the package. This specific embodiment and an alternate embodiment of the tab configuration have been chosen for the purposes of illustration and description as shown in the accompanying drawings wherein:

BRIEF DESCRIPTION OF THE DRAWINGS

In the following descriptions and in the claims various details will be identified by specific names for convenience. These specific identifications are intended to be generic in their application. Corresponding reference characters refer to like members throughout the ten figures of the drawings.

The drawings accompanying, and forming part of, this specification disclose certain details of construction for the purpose of explanation but it should be understood that structural details may be modified and that the invention may be incorporated in other structural forms than shown.

Figure 1:
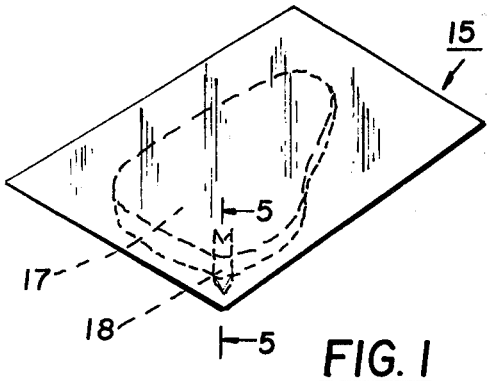
FIG. 1 represents an isometric view partly diagrammatic showing a packaged product and the relationship of the tear-inducing tab as retained in the finished package.
Figure 5:
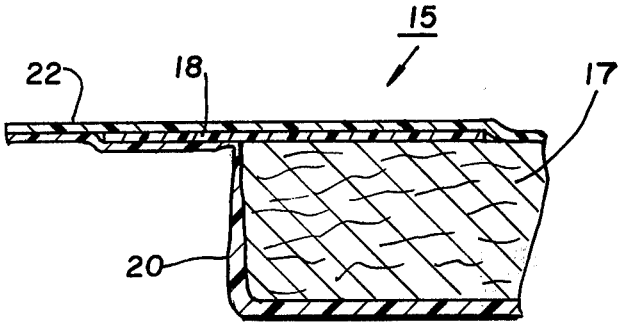
FIG. 5 represents in an enlarged sectional view a corner of the package and product of FIG. 1, this view taken on the line 5—5 of FIG. 1.

Package of FIGS. 1 and 5

Figure 7:
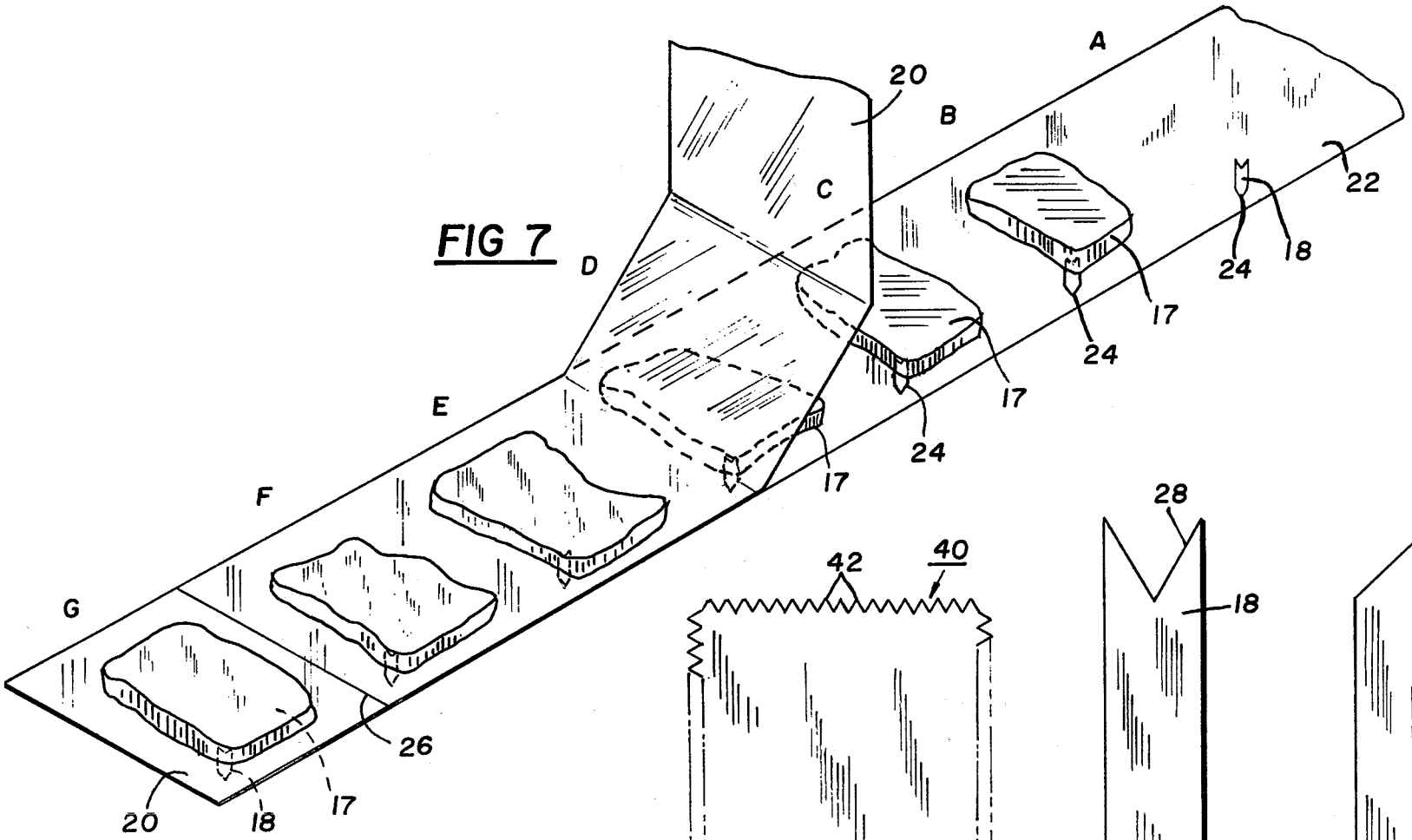
FIG. 7 represents an isometric view partially diagrammatic and showing a typical sequence for forming the package with a tear-inducing tab incorporated into the package in accordance with known procedures to produce the packaged product of FIG. 1.

Referring now to FIG. 1, there is depicted a package generally indicated as 15 in which a product 17 carries on its upper surface a tear-inducing tab 18. As seen in FIG. 5, the product 17 is sealed by and between an upper film 20 drawn over the top and around the sides of the product and then to and around the leftwardly projecting portion of the tear-inducing tab 18. The peripheral portion of film 20 is sealed to bottom film 22 as by heat sealing. This package of FIGS. 1 and 5, as shown, is turned one hundred eighty degrees from the normal production package forming arrangement as seen in FIG. 7.

Figure 2:
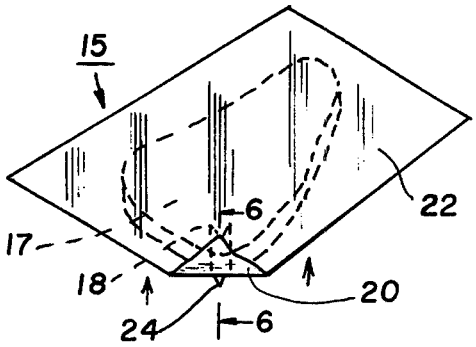
FIG. 2 represents the isometric view of the packaged product as in FIG. 1 but with a corner of the film portion containing the tear-inducing tab being manipulated into a bent condition so that the sharp projecting point of the tear-inducing tab ruptures one local area of one of the films.
Figure 6:
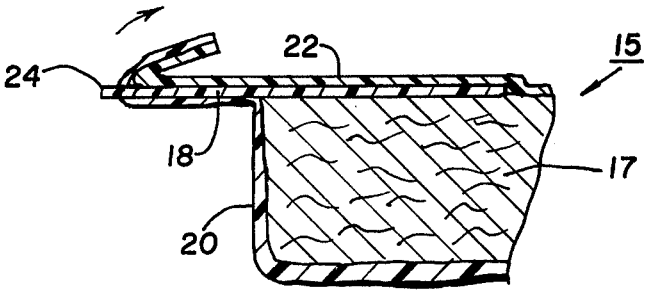
FIG. 6 represents a sectional view in an enlarged scale of the corner of the film portion of the package being bent and manipulated so that a rupture of the film is induced as the point of the tear-inducing tab pierces one of the films of the package, this view being taken on the line 6—6 of FIG. 2.

Package of FIGS. 2 and 6

Referring next to FIGS. 2 and 6, there is depicted the package of FIG. 1 but with the corner portion thereof containing the tear-inducing tab 18 now bent and manipulated so that upper film 20 is locally pierced by the sharp point 24 of the tab 18. As soon as a rupture has been made in film 20 a persistent and steady pull in the direction of the arrow and on the extending peripherally sealed portions causes the film 20 to continue to tear. As seen in FIGS. 5 and 6, the portion of film 20 that has been drawn down the sides of the product 17 has been thinned during the packaging process and hence is more easily torn than bottom film 22.

Figure 3:
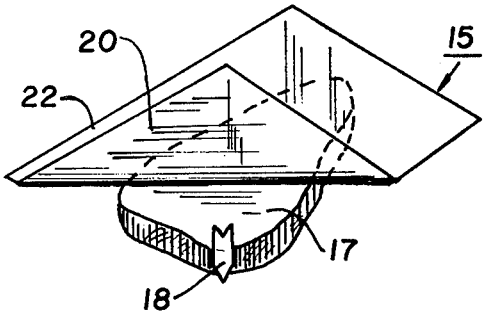
FIG. 3 represents an isometric view of the packaged product of FIG. 2 with the product now substantially exposed with and by increasing the tear of the film after the tear has been initiated, the tear now sufficient so that a portion of the film around the product has been lifted to expose the product.

Package of FIG. 3

The diagrammatic representation of the package 15 of FIG. 3 shows the package of FIG. 2 but with the corner further pulled to increase the tear of film 20 with the resulting further uncovering of the product 17. The tear-inducing tab 18 is shown as laying on the top of the product 17 but sometimes remains with the corner portion of the package wrap.

Figure 4:
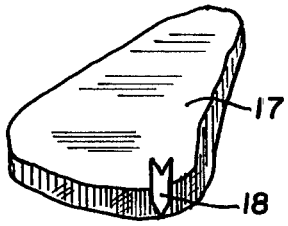
FIG. 4 represents an isometric view of the product of FIG. 3 with the film removed but with the tear-inducing tab still resting on the product.

Product of FIG. 4

The diagrammatic representation of FIG. 4 shows the product 17 now stripped of the film wrapper. When the tear-inducing tab 18 sticks to the product 17, as depicted, it may now be removed and discarded.

Method of Packaging as in FIG. 7

Referring next to FIG. 7, there is a diagrammatic representation of the several steps required to provide the final packaging of the product as in FIG. 1. To the extent that the processing steps therein are used to produce the instant package, the packaging steps of U.S. Pat. No. 3,491,504 as issued to W. E. Young et al. on Jan. 27th, 1970 is incorporated into this process by reference.

As depicted, the lower film 22 is carried on a support means such as a conveyor and as a strip is fed to station A. By manual manipulation or mechanical means a tear-inducing tab 18 is placed on the upper surface of film 22 and is so positioned that the sharp point 24 is directed toward a near edge of the film. The film is now advanced to station B where by manual or mechanical means a product 17 is placed on the lower film 22. The product 17 is placed so that the point 24 of the tab protrudes beyond the edge of the product 17.

At station C the upper film 20 is shown approaching the product 17 and lower film 22 and at station D film 20 is brought near to the lower film 22. Prior to this or at this period in time the films are heated or otherwise conditioned for sealing to each other. At stations E and F the package is formed usually with or in the presence of reduced pressure. The top film 20 is drawn over the top and down the sides of the product 17 and at and around the projecting portion of the tear-inducing tab covers its top and sides and then is sealed to the lower film 22 at the support plane of this lower film. At station G the package may be severed at line 26. The package 15 as trimmed has a peripheral sealing portion and the projecting portion of tear-inducing tab 18 is retained in this peripheral portion until the package is opened as described above in conjunction with FIGS. 2, 3, 4 and 6. Whether a heat sealing technique is employed or an adhesive is used to join upper and lower films 20 and 22 the projecting portion of tear-inducing tab 18 is retained in a film sheath and the remaining portion is tightly maintained against one surface or portion of the product.

Figure 8:
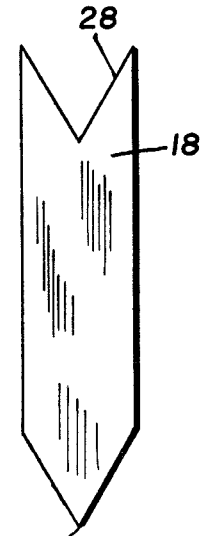
FIG. 8 represents in an enlarged scale a plan view of a tear-inducing tab which is economically punched from a strip of substantially rigid plastic.

Tear-Inducing Tab of FIG. 8

In FIG. 8 is depicted in enlarged scale the tear-inducing tab 18 of FIG. 1. Economically the tab is made from plastic strip stock fifteen- to twenty-thousandths of an inch thick and of considerable stiffness. A sharp point 24 is die punched from the strip stock and this point leaves a V-shaped recess 28 in the preceeding tab. Of course, the sides of the tab may also be cut by the die. The depicted point is a 60° included angle but may be more or less.

Figure 9:
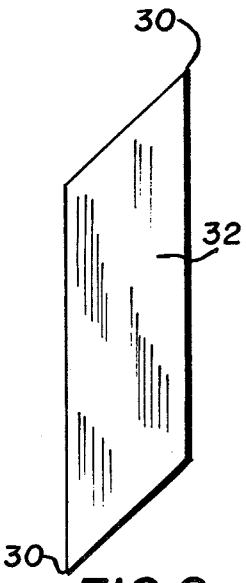
FIG. 9 represents in an enlarged scale a plan view of an alternate tear-inducing tab punched from a flat plastic strip.

Tear-Inducing Tab of FIG. 9

Referring next to FIG. 9, there is shown an alternate configuration of a tear-inducing tab. As illustrated, a sharp point 30 is formed on tab 32 by making a diagonal cut of about forty-five degrees. This cut provides a double ended tab. As in the tab of FIG. 8, the angle of cut may be changed and the tab may be cut singly from a strip of plastic or the longitudinal sides may also be cut by the die to provide multiple production.

Figure 10:
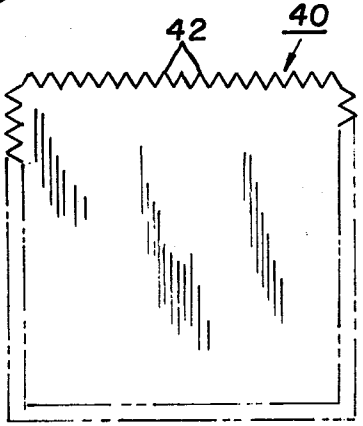
FIG. 10 represents an alternate tear-inducing tab which is a rectangular member having serrated edges, this tear-inducing member configured to generally receive and support the product within the inner extents of the serrations.

Tear-Inducing Tab Member of FIG. 10

Referring next and finally to FIG. 10, there is shown a tear-inducing tab member 40 which is also of thin plastic. Instead of one sharp protruding point, member 40 is formed with a series of sharp points 42 arranged along each side of this member. This member provides a support for the product after member 40 has been placed on the lower film 22. The product to be placed on the member 40 is of such a size that when placed on member 40 the points 42 extend beyond the perimeter of the product. When the upper film 20 is sealed to the lower film 22 the points 42 are enclosed until the sealed films are bent to bring a sharp point against one of the films to rupture the film to permit tearing of the film.

It is to be noted that the tear-inducing tab 18 may be arranged so that the dual points provided by cut 28 may be arranged to project from the side of the product. Other configurations than those shown may be used for the tear-inducing tab but whatever configuration is used it is contemplated in the method of forming a package that at least one sharp point will extend beyond the periphery of the product and the upper and lower films are drawn around the point of the tear-inducing tab with the films also sealed to each other to provide a retaining protection of the point until the film is bent to rupture the film. It is to be further noted that this method insures that the tear-inducing tab may be retained to and by either or both of the films by an adhesive coating or by heat sealing the tab to one or both of the adjacent films. It is also to be noted that the tab may be used in a package where the upper film has been preformed.

Terms such as "up", "down", "bottom", "top", "front", "back", "clockwise", "counterclockwise" and the like are applicable to the embodiments shown and described in conjunction with the drawings. These terms are merely for the purpose of description and do not necessarily apply to the position in which the package having a tear-inducing means to rupture a film may be constructed or used. While particular embodiments of the tear-inducing tab have been shown and described it is to be understood the invention is not limited thereto and modifications may be made within the scope of the accompanying claims and protection is sought to the broadest extent the prior art allows.

What is claimed is:

1. The method of forming a package with a tear-inducing means which is associated with the positioning of a product of determined size, said method including the steps of: (a) providing a lower flexible film having a width and length greater than the product to be packaged; (b) forming and providing a tear-inducing tab of relative thinness and having a substantial stiffness to resist bending of the tab, said forming including causing a sharp pointed end portion to be provided; (c) placing said tear-inducing tab on the lower film and positioning this tab so that the pointed portion is directed toward an edge of the lower film and at a selected distance inwardly from the edge of the lower film; (d) placing and positioning a product of selected size on the lower film so that the periphery of the product is at least a short distance in from the ends and side edges of the lower film and also positioning the product so that the sharp pointed portion and a short adjacent portion of the tear-inducing tab extends beyond the periphery of the product, and (e) providing and positioning an upper flexible film over the lower film and product, the upper film being of substantially the same size as the lower film and drawing the upper film tightly around the top and sides of the product and sealing the upper and lower films to encase the product and that projecting portion of the tear-inducing tab which extends beyond the product, the projecting sharpened end as thus arranged effecting a puncture of one of the films when the projecting edge portion of the package is bent sufficiently to cause the sharp point to pierce the film.

2. The method of forming a package as in claim 1 in which the upper and lower films are thermoplastic and the forming of the package further includes bringing the product to a condition of reduced pressure and heating the peripheral portions of the films to a sealing condition and pressing the peripheral portions of the films together.

3. The method of forming a package as in claim 2 which includes forming the tear-inducing tab with a sharp pointed portion as a V-shape.

4. The method of forming a package as in claim 2 which includes forming the tear-inducing tab with a sharp diagonal point by causing a diagonal cut to be made across a strip of plastic stock material.

5. The method of forming a package as in claim 2 which further includes forming the tear-inducing tab from a strip of plastic which is about one thirty-second of an inch in thickness.

6. The method of forming a package as in claim 1 which further includes the step of trimming the package to produce outwardly extending sealed portions of upper and lower films which between them retain the projecting pointed end of the tab with said extending sealed portion adapted for manipulation into a U-shape and then by this manipulation causing a deliberate rupture of one of the films to be accomplished and a further tearing of the film for opening the package and exposing the product.

* * * * *